United States Patent [19]

Riegger et al.

[11] Patent Number: 4,461,244

[45] Date of Patent: Jul. 24, 1984

[54] VERTICAL, COLLECTOR-TYPE HIGH-PRESSURE FEED WATER PREHEATER, WITH DESUPERHEATER AND A DEVICE FOR SEPARATING THE STEAM AND WATER PHASES

[75] Inventors: Helena Riegger, Zürich; Jörg Schwander, Laufen, both of Switzerland; Günter Volks, Lauchringen, Fed. Rep. of Germany

[73] Assignee: BBC Brown, Boveri & Company, Limited, Baden, Switzerland

[21] Appl. No.: 508,652

[22] Filed: Jun. 28, 1983

[30] Foreign Application Priority Data

Jun. 30, 1982 [CH] Switzerland ..... 3992/82

[51] Int. Cl.[3] ..... F22D 1/28

[52] U.S. Cl. ..... 122/441; 165/112; 165/113

[58] Field of Search ..... 122/441, 442, 443, 451 R, 122/451 S; 165/112, 113

[56] References Cited

U.S. PATENT DOCUMENTS

| | | | |
|---|---|---|---|
| 3,938,588 | 2/1976 | Coit et al. | 165/113 |
| 4,224,981 | 9/1980 | Datz et al. | 165/114 |
| 4,249,485 | 2/1981 | Brul et al. | 122/441 |

*Primary Examiner*—Edward G. Favors

*Attorney, Agent, or Firm*—Oblon, Fisher, Spivak, McClelland & Maier

[57] ABSTRACT

A steam duct (5) enclosing the preheater tube-bundle (6) leads, upwards, from the desuperheater box (2) and via a deflecting quarter-bend (9), opens into a flat steam-distribution duct (8). The heating steam flows from this distribution duct (8), through steam outlet openings (12) on the vertical narrow sides (11), and thereafter flows radially through the preheater tube-bundles (6), from the outside to the inside.

4 Claims, 9 Drawing Figures

VERTICAL, COLLECTOR-TYPE HIGH-PRESSURE FEED WATER PREHEATER, WITH DESUPERHEATER AND A DEVICE FOR SEPARATING THE STEAM AND WATER PHASES

BACKGROUND OF THE INVENTION

1. Field of the Invention:

The present invention relates to a vertical, collector-type high-pressure feed water preheater, with desuperheater and a device for separating the steam and water phases.

2. Description of the Prior Art:

In steam power plants, the feed water, which is maintained at a super-atmospheric pressure, is heated to the desired final temperature in high-pressure preheaters by means of steam which is bled from the turbines.

If, as is usually the case, the bleed steam is superheated steam, it is then possible to impart a portion of the superheating heat to the feed water, in a desuperheater which, viewed in the direction in which the feed water to be heated is flowing, encloses the end portion of the preheater tube-bundle, the steam flow-paths, along the tubes in the desuperheater, being provided by means of guide plates. At the end of that portion of the feed water tube-bundle through which it flows in a counter-current direction, the steam enters the condensation section, where it is condensed.

If, as the steam emerges from the desuperheater, the steam velocities are locally high, the preheater tubes suffer erosion damage as the steam collides with the condensate which is trickling down from the tube-bundles. This process endangers the tubes of preheaters in which the steam flows upwards, but the tubes of preheaters in which the steam flows downwards are also at risk.

Feed water preheaters are known which possess desuperheaters which are open in the upward direction, or which are only partially closed, so that the steam can flow out, upwards, at a high velocity and, at the same time, can carry the condensate formed in the upper portion of the preheater upwards, which causes erosion in that region. In order to reduce the velocity at which the steam leaves the desuperheater, an aperture has accordingly been provided, in a further design, in the dividing wall between the desuperheater compartment and the condensation compartment, this aperture being intended to shortcircuit a portion of the steam flow and to reduce the velocity of the remainder of the steam to the extent that the abovementioned erosion is largely prevented. However, this measure has led to more severe erosion in the condensation zone, since the steam flowing into this zone, through the abovementioned aperture, strikes condensate droplets which are even larger than those in the upper portion of the preheater tube-bundles.

SUMMARY OF THE INVENTION

An object of the present invention is to design the desuperheater in a manner such that, in the regions where the steam velocities are high, the collision of steam with the downward-trickling condensate is largely avoided and the erosion damage resulting therefrom, which can also occur, moreover, at the tube-supports, is also largely prevented. In addition, the invention is intended to prevent the condensate from falling into the desuperheater, especially during normal operation, during load changes and during the process of shutting down the power plant, since this would adversely affect the thermodynamic efficiency of the desuperheater.

The invention is therefore concerned with achieving a separation of the two phases, steam and water, at every point where collision of these phases can lead to erosion effects. A further object of the invention is to configure those elements of the boundary surface of the desuperheater which partition off the tube-bundles with respect to the steam ducts, at right-angles to the length of the bundles, in a manner such that the installation costs become as low as possible and, compared to the conventional technique, only a few welding operations are required, which are easy to carry out at accessible points.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
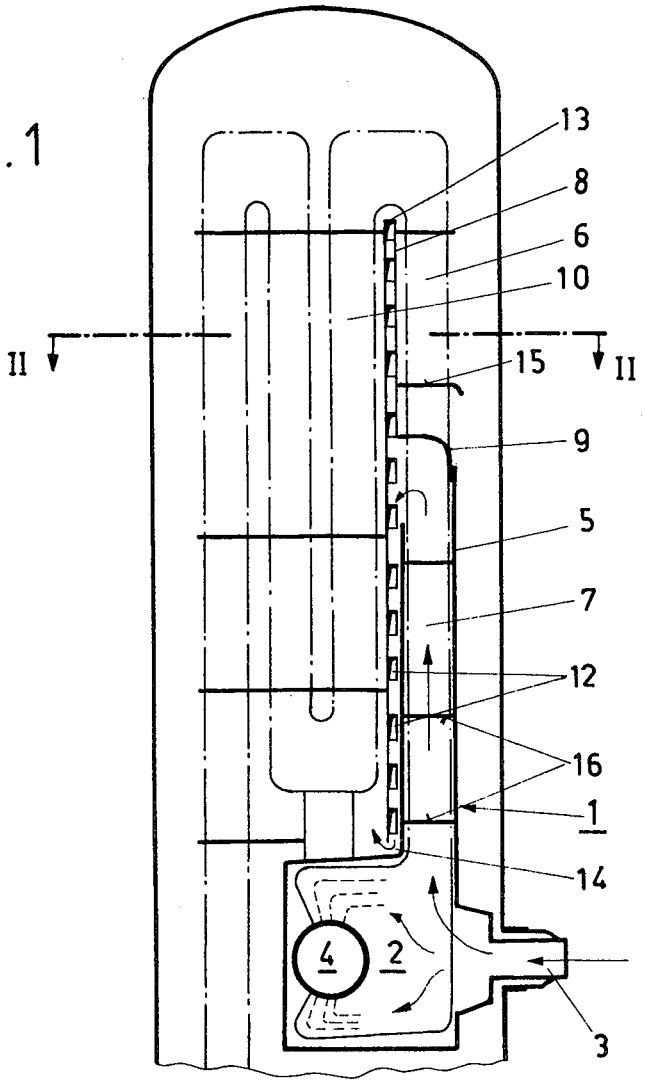
FIG. 1 schematically shows, a vertical section through a vertical high-pressure feed water preheater.
Figure 2:
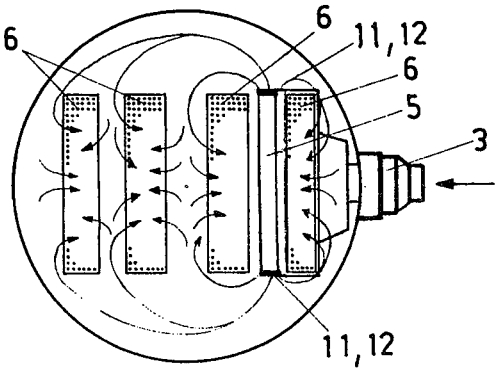
FIG. 2 shows a cross-section a the sectionline II—II in FIG. 1.

In the vertical high-pressure feed water preheater shown in FIG. 1, the condensate collector, which occupies a position beneath the desuperheater 1, is omitted, since it is not essential to the invention.

The main parts of the desuperheater 1 are essentially a desuperheater box 2, on which the steam inlet pipe-connection 3 is seated, and which houses the outlet feed water collector 4, a steam duct 5, which extends upwards and, viewed in the direction in which the feed water flows, contains the last leg 7 of the preheater tubebundle 6, and, in addition, a steam-distribution duct 8 and a deflecting quarter-bend 9, the latter connecting the steam duct 5, at its upper end, to the steam-distribution duct 8. This distribution duct 8 is shallow, and forms a dividing wall between the last leg 7 of the preheater tube-bundle 6 and its penultimate leg, 10. On its two vertical narrow sides 11, the distribution duct 8 possesses a series of steam outlet openings 12, which are distributed over the entire vertical extent of these sides, whereas its upper, horizontal narrow side 13 is closed, and its lower, horizontal narrow side is open, over the entire width, and thereby forms a long steam outlet slot 14. A horizontal condensate catch-plate 15 is attached to the steam-distribution duct 8, above the deflecting quarter-bend 9. A number of support points 16 are located inside the steam duct 5, the individual serpentine tubes of the preheater tube-bundle 6 being secured at these support points in a known manner, such that they are fixed in all directions at right-angles to their length, but can shift freely in their longitudinal direction in order to avoid impeding the thermal expansions.

Figure 6:
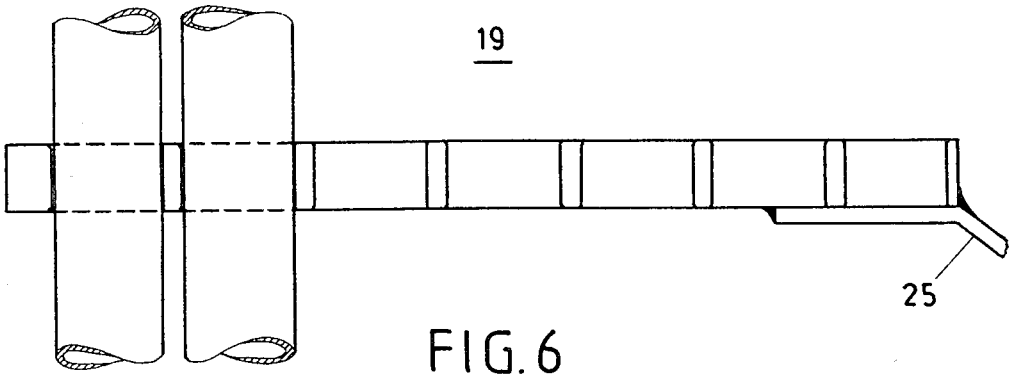
Figure 7:
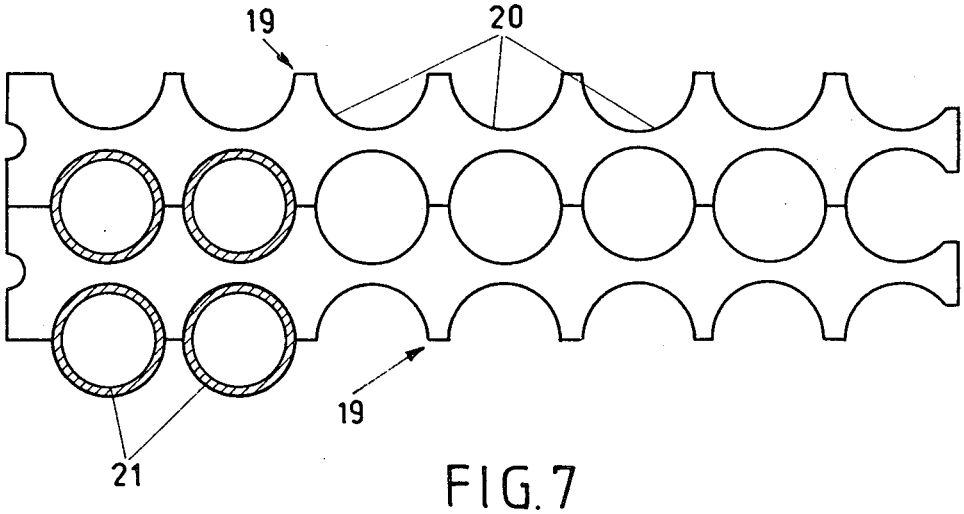
Figure 8:
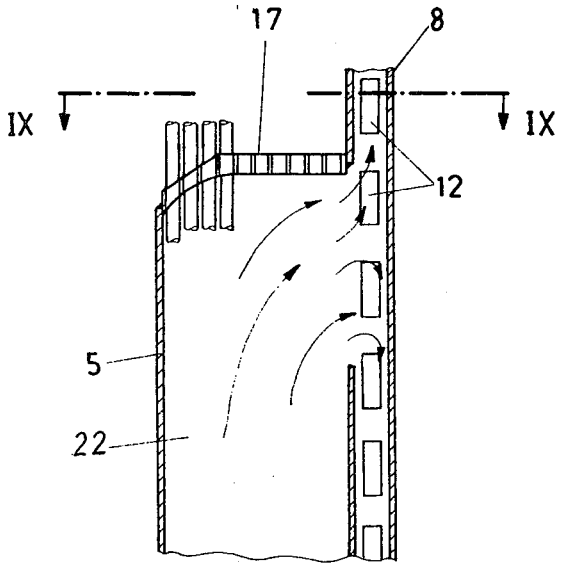
FIGS. 8 and 9 show, in elevation and in plan, a portion of a steam duct of a desuperheater, with closure-plates.
Figure 9:
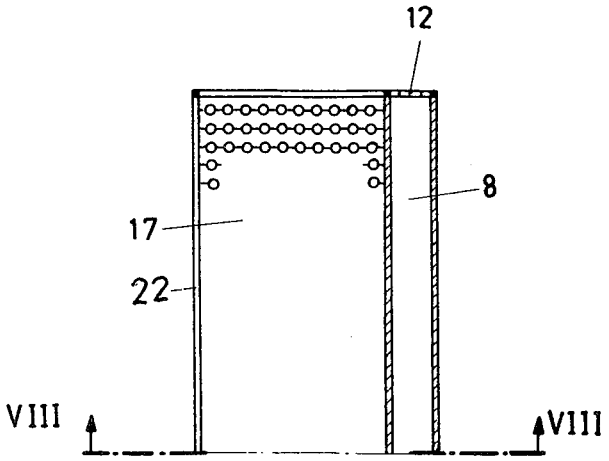

With the exception of the condensate catch-plate 15 and a closure-plate on the top of the deflecting quarter-bend 9, the desuperheater is of welded sheet-metal construction. The joint between the closure-plate, which is marked 17, and the vertical walls of the desuperheater is shown in FIGS. 8 and 9, this plate simply being welded, at its four edges to three walls of the steam duct 5 and to one wall of the steam-distribution duct 8. Both the closure-plate 17 and the condensate catch-plate 15 are assembled from elements which permit the serpentine tubes of the preheater tube-bundle 6 to be installed in a very simple manner. The closure-plate elements 18, from which the closure-plate is assembled, are shown in FIGS. 3 to 5, while the condensate catch-plate elements 19 are shown in FIGS. 6 and 7, each type of element being shown both in elevation and plan.

Figure 3:
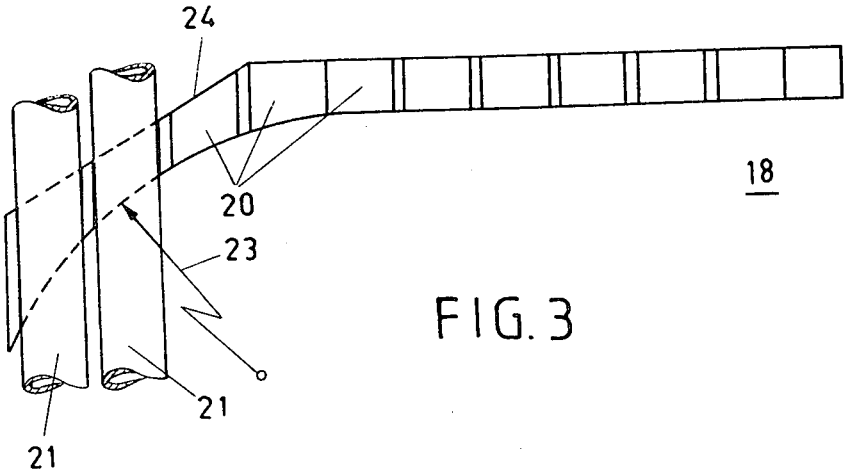
FIGS. 3 to 5 show a closure-plate element, in elevation and in plan; the FIGS. 6 and 7 show an element of a condensate catchplate, in elevation and in plan.
Figure 4:
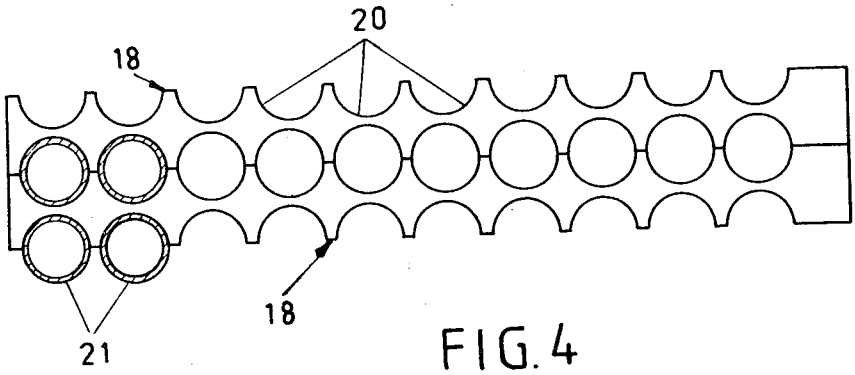
Figure 5:
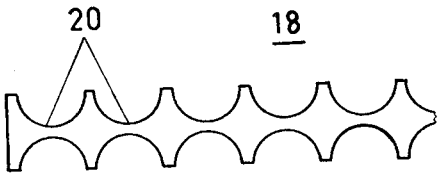

It can be seen, from FIGS. 3 to 5, that the width of a closure-plate element 18 is equal to the center to-center spacing of two adjacent layers of tubes. The two vertical longitudinal sides are furnished with semicircular recesses 20, distributed along the entire length, through which the tubes 21 of the preheater tube-bundles are led. Two elements 18, placed side-by-side, are shown in FIG. 4, while FIG. 5 shows, in plan view, a portion of an individual element.

On installing the preheater tube-bundle, the individual layers of serpentine tubes are inserted into a recesses 20 of an element 18, after which the second element 18 is fitted on top, and so on, and the completely assembled closure-plate is finally welded into the sheet-metal structure of the desuperheater, as mentioned above.

FIGS. 3 and 8 show that the elements 18 possess, on the underside, a curvature 23 at the transition from the outer vertical wall 22 of the steam duct 5 to the horizontal portion of the closure-plate 17, and that they possess a sloping area 24 on their upper sides.

The curvature 23 enables the steam to be deflected from the steam duct 5 into the steam-distribution duct 8 in an aerodynamically efficient manner, as a result of which stagnating zones, in which condensate could form and which would involve erosion risks, are also prevented from occurring in the steam. The slopping area 24 ensures that condensate which collects on the upper side can flow away.

The condensate catch-plate 15 which, as can be seen from FIG. 1, is welded onto one wall of the steamdistribution duct, above the closure-plate 17, is assembled from the elements 19 shown in FIGS. 6 and 7. After the plate 15 has been assembled from the elements 19, a drip-rail 25 is welded onto its free end, this drip-rail preventing condensate from dripping down onto the closure-plate, as well as holding the elements 19 together at their free ends.

The functional advantage of this design of the desuperheater resides in the fact that the steam entering the steam-distribution duct 8 via the steam duct 5 is uniformly distributed to its narrow sides 11, and flows outwards through the steam outlet openings 12, whence it then flows radially into the tube-bundles, from the outside to the inside, and condenses. A portion of the steam flows downwards, through the steam outlet slot 14, which simultaneously serves as a drain for condensate forming in the steam-distribution duct 8.

In accordance with the object of the invention, this desuperheater brings about a well defined separation of the two flowing phases, namely the steam emerging from the steam-distribution duct 8 and the water which trickles down from the upper portions of the condensation surface, that is to say from the upper portions of the tube-bundles. Obviously, numerous modifications and variations of the present invention are possible in light of the above teachings. It is therefore to be understood that within the scope of the appended claims, the invention may be practiced otherwise than as specifically described herein.

We claim:

1. A vertical, collector type high pressure feed water preheater comprising:

a shell;

a preheater tube bundle in said shell, through which feed water flows, said preheater tube bundle having a transverse width and having a last leg in a direction of said feed water flow;

a desuperheater in said shell, said desuperheater including a desuperheater box enclosing an outlet feed water collector, said desuperheater further including a steam duct extending upward from said desuperheater box, said steam duct enclosing at least a portion of said last leg in a fluid tight manner, an upper end of said steam duct having a quarter bend;

a steam distribution duct positioned between said last leg and a portion of a remainder of said preheater tube bundle, said steam distribution duct defining a flat box in fluid communication with said upper end of said desuperheater steam duct, said flat box extending across said preheater tube bundle transverse width;

a plurality of first vertically spaced steam outlet opening formed on transverse ends of said flat box; and a second steam outlet opening formed on a bottom of said flat box.

2. The high-pressure feed water preheater of claim 1 wherein a horizontal, upper boundary surface of said quarter-bend is formed by a closure-plate through which tubes of said preheater tube-bundle extend into the steam duct, and wherein said closure-plate is assembled from bar-shaped closure-plate elements, the width of said closure-plate elements being equal to a spacing of two adjacent layers of said tubes, wherein vertical longitudinal sides of said closure-plate elements possess first semicircular recesses distributed along the length of said vertical longitudinal sides, a radius of said first semicircular recesses being equal to half of an outer diameter of said tubes.

3. The high-pressure feed water preheater of claim 2 wherein said closure-plate elements exhibit a curvature on a side opposite said steam distribution duct, wherein said closureplate is welded, at a horizontal periphery thereof, to sheet-metal walls of said desuperheater steam duct, and wherein said closure-plate possesses a sloping area at an upper one of said vertical longitudinal sides.

4. The high-pressure feed water preheater of claim 3 including a condensate catch-plate assembled from bar-shaped condensate catch-plate elements and welded to said steam distribution duct above said closure-plate, a width of said condensate catch-plate elements being equal to said spacing of said two adjacent layers of tubes, wherein vertical longitudinal sides of said catch-plate elements possess second semicircular recesses distributed along the length of said vertical longitudinal sides, a radius of said second semicircular recesses being equal to half of an outer diameter of said tubes wherein free ends of said condensate catch-plate elements are interconnected by a drip-rail which is welded to undersides of said catch-plate elements.

* * * * *